US006039468A

United States Patent [19]

Kowalcyzk

[11] Patent Number: 6,039,468

[45] Date of Patent: Mar. 21, 2000

[54] WASHOUT ASSEMBLY FOR CEMENT MIXER VEHICLE

[76] Inventor: Dennis Kowalcyzk, 7712 Princeton Pl., Middleburg Heights, Ohio 44130

[21] Appl. No.: 09/053,979

[22] Filed: Apr. 2, 1998

[51] Int. Cl.[7] ..... B28C 5/18; B28C 7/14

[52] U.S. Cl. ..... 366/41; 366/54

[58] Field of Search ..... 366/26, 30, 36, 366/39, 41, 44, 53–59, 62, 68, 138, 349, 606

[56] References Cited

U.S. PATENT DOCUMENTS

| | | | |
|---|---|---|---|
| 1,025,462 | 5/1912 | Foote | 366/36 |
| 1,696,751 | 12/1928 | Burket | 366/36 |
| 2,327,473 | 8/1943 | Wagner et al. | 366/26 |
| 3,112,100 | 11/1963 | Prichard | 366/41 |
| 3,246,884 | 4/1966 | Prichard et al. | 366/41 |
| 3,567,189 | 3/1971 | Buelow | 366/44 |
| 4,127,478 | 11/1978 | Miller . | |
| 4,268,175 | 5/1981 | Norlie et al. | 366/41 |
| 4,762,421 | 8/1988 | Christenson et al. | 366/54 |
| 5,018,593 | 5/1991 | Hermann . | |
| 5,056,641 | 10/1991 | Loefke et al. . | |
| 5,064,292 | 11/1991 | Sutton . | |
| 5,178,252 | 1/1993 | Smith . | |
| 5,192,178 | 3/1993 | Silbernagel . | |
| 5,498,021 | 3/1996 | Christenson . | |
| 5,741,065 | 4/1998 | Bell et al. | 366/41 |

FOREIGN PATENT DOCUMENTS

| | | | |
|---|---|---|---|
| 740437 | 10/1943 | Germany | 366/39 |
| 313814 | 6/1929 | United Kingdom | 366/39 |

*Primary Examiner*—Charles E. Cooley
*Attorney, Agent, or Firm*—Renner, Otto, Boisselle & Sklar, P.L.L.

[57] ABSTRACT

A washout bucket which receives waste water and concrete material washed from equipment used to deliver concrete material from the mixing drum of a cement mixer truck to a desired location on a job site, is used in cooperation with a tag axle assembly pivotally mounted on a rear end of the truck to recover the concrete material washed from the equipment. The washout bucket can be connected to the tag axle assembly. The tag axle assembly is then raised to an upright position and in the process the front of the washout bucket contacts the mixing drum and tips over, emptying the waste material into the mixing drum. As a result, waste concrete material can be properly disposed of or salvaged for reuse rather than indiscriminately washed onto the ground at the job site.

12 Claims, 14 Drawing Sheets

WASHOUT ASSEMBLY FOR CEMENT MIXER VEHICLE

FIELD OF THE INVENTION

The present invention relates generally to material-hauling vehicles utilizing an auxiliary load supporting axle and, more particularly, to a concrete mixer truck having a tag axle assembly.

BACKGROUND OF THE INVENTION

Concrete or cement mixer trucks generally include a cab and a rotatable drum behind the cab that contains and mixes concrete materials. Such trucks typically include a single set of forward steering wheels and a plurality of rear, load supporting drive axles mounted on an elongated chassis which supports the cab and the drum.

Most federal, state and local highways and bridges have load limits which limit the overall vehicle weight, the weight per axle and the spacing of the axles. Auxiliary axles may be used to provide additional load-bearing wheels which can be lifted from the road surface when the additional wheels are not needed.

One type of auxiliary axle used with cement mixer trucks is generally referred to as a "tag axle" which is a separate high lift axle assembly pivotally mounted to the rear of the truck chassis. Tag axles generally include a mechanism for lowering the assembly so that the wheels may engage the road surface behind the truck to significantly increase the legal load carrying capacity of the truck. The increased load carrying capacity is effected not only by the fact that the load is spread over more axles, but also because the distance between the front and rearmost axles is significantly increased.

Tag axles generally are raised and lowered by means of a hydraulic system which can lower the tag axle to the road surface to share the load with the steering and drive wheels, and which can raise the tag axle up and out of the way to transport relatively light loads, to improve off-road maneuverability and/or to discharge material from the cement mixer. Further information regarding cement mixers and tag axle assemblies may be found, for example, in U.S. Pat. No. 5,498,021.

After material is discharged from the mixer, a problem remains regarding how to clean the equipment, such as a chute extending from the truck, used to deliver the material from the truck. The general practice is to wash off the equipment onto the ground. This leaves an undesirable and wasteful deposit of cement and/or other concrete materials at a construction or job site.

SUMMARY OF THE INVENTION

The present invention provides a washout assembly used with a cement mixer truck having a tag axle assembly to recover waste concrete material at a job site. This material can then be re-used or properly disposed of at a remote location. More specifically, the present invention provides a washout assembly which receives material washed from equipment used to deliver concrete materials from the truck to a desired location. The tag axle assembly is connected to a rear end of the truck. The washout assembly is connectable to the tag axle assembly which can be raised to empty the washout assembly into the truck and, more particularly, into a mixing drum mounted on the truck.

According to one embodiment of the present invention, the washout assembly includes a container to receive waste washed from equipment used to deliver the concrete material and a mounting assembly which connects the container to the tag axle assembly.

Preferably, the mounting assembly is pivotally connected to the tag axle assembly at opposite sides of the container along a horizontal tip axis. The mounting assembly removably connects the container to the tag axle assembly, and more particularly, the mounting assembly is mounted to the tag axle assembly and removably connected to the container.

According to another aspect of the present invention, the mounting assembly includes at least one telescoping extension member mounted to the tag axle assembly. Preferably, the mounting assembly includes at least one pivot which connects the container and the telescoping extension member.

According to another aspect of the present invention, the container has a forward tip surface against which a force may be applied to tip the container about the horizontal tip axis. The tip surface is preferably formed by at least one tip bracket extending from a front surface of the container.

The container has at least one wheel and more preferably, a pair of wheels and a handle, to facilitate moving the container when the container is disconnected from the tag axle assembly.

The present invention also contemplates a method of recovering the waste washed from the equipment used to deliver the concrete material. The method includes the steps of: (1) washing concrete material from the equipment into a washout assembly; (2) connecting the washout assembly to the tag axle assembly; and (3) emptying the washout assembly into the mixing drum.

According to one aspect of the method, the step of washing concrete material from the equipment includes washing concrete material and debris from tools and a cement chute. Preferably the emptying step includes rotating the tag axle assembly to empty the washout assembly into the mixing drum of the truck. The emptying step includes rotating the tag axle assembly such that the container contacts the truck at a point of contact. Continued rotation of the tag axle assembly and rotation of the container about the point of contact cooperate to empty the container into the mixing drum. The connecting step also may include the steps of extending the telescoping member and connecting the container to the telescoping member with the pivot.

According to further aspects of the invention, the method may include the step of washing out the rotated container into the mixing drum, and the step of disconnecting the washout container from the tag axle assembly. The method may further include the step of attaching the washout assembly to the truck to transport the washout assembly with the truck. The attaching step includes connecting a first side of the container to a bracket mounted on the truck and securing a second side of the container to the truck with a releasable hook.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION

Figure 1:
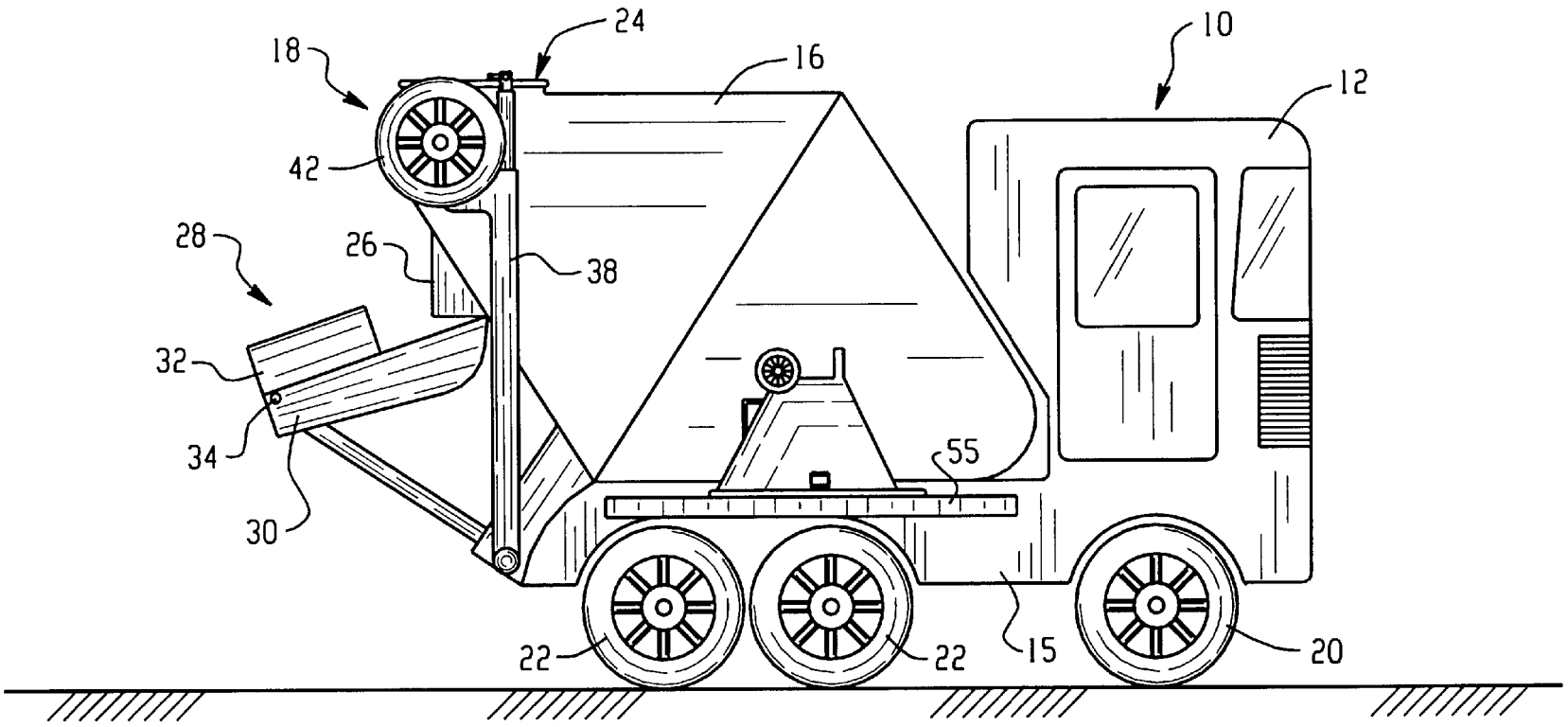
FIG. 1 is a schematic elevational view of a concrete mixer truck having a tag axle assembly, with a washout container of a washout assembly according to the present invention loaded onto a catwalk of the truck for transport.
Figure 2:
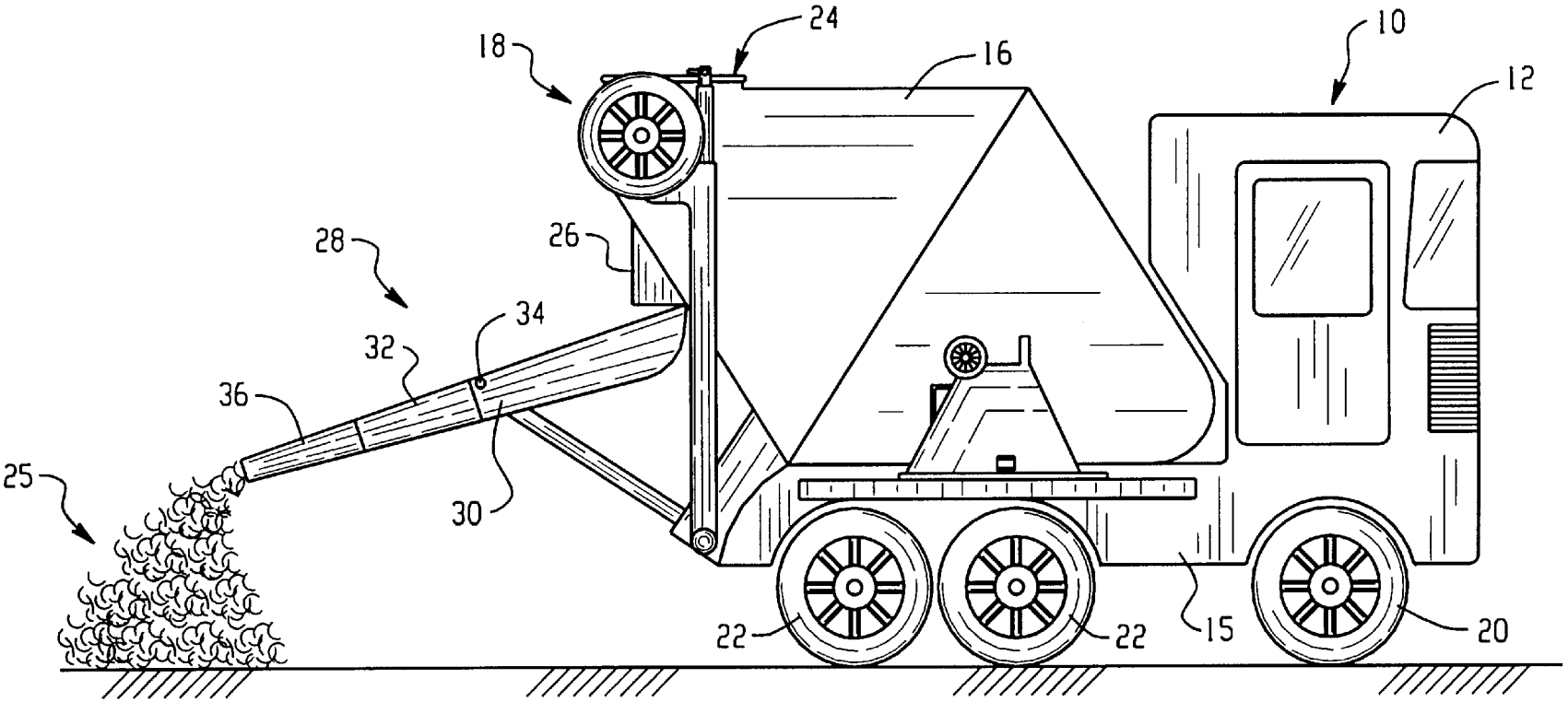
FIG. 2 is a schematic elevational view of the concrete mixer truck delivering concrete materials through a multi-section chute.
Figure 3:
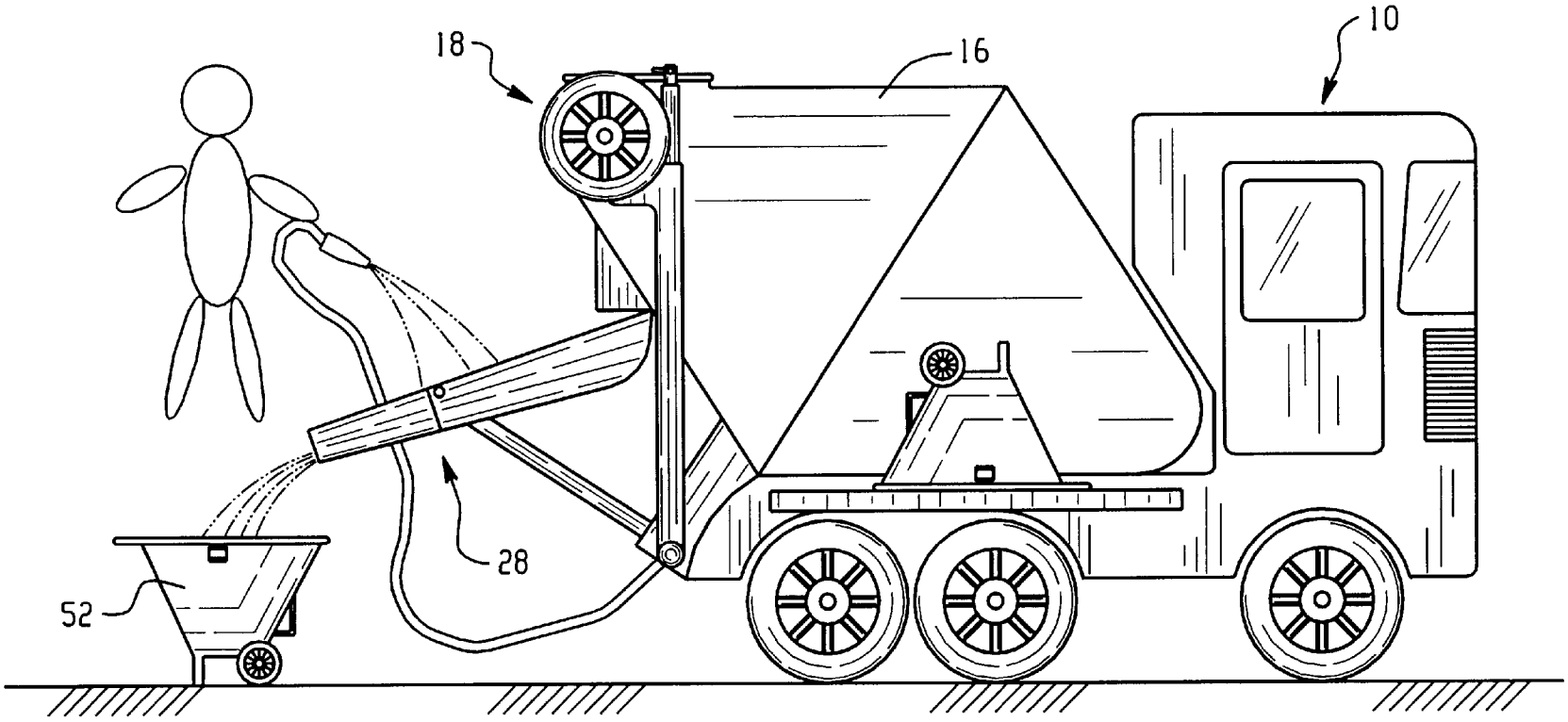
FIG. 3 is a schematic elevational view of the concrete truck with the washout container removed from the catwalk and positioned to receive waste washed from a chute after concrete materials have been delivered.

Referring now in detail to the drawings, and in particular to FIGS. 1 and 2, the present invention contemplates a washout assembly (described in detail below) used with a cement or concrete mixing truck 10 having a cab 12 mounted on a front end of a heavy truck chassis or frame 15, a rotatable mixing drum 16 mounted on the chassis behind the cab, and a tag axle assembly 18 pivotally mounted to a rear end of the chassis. The chassis is supported by a plurality of axle mounted wheels including a pair of steering wheels 20 at a forward end of the chassis and at least two sets of drive wheels located toward the rear of the chassis 22. Each set of drive wheels may include dual wheels. The washout assembly (described below) facilitates recovery of waste material washed from equipment used to deliver concrete materials and in cooperation with the tag axle assembly deposits the waste material into the mixing drum for treatment or disposal at a remote location.

The mixing drum 16 has an opening (not visible) toward the rear of the truck which is higher than a base of the drum. A loading funnel 24 forms a substantially vertical passage into the mixing drum from above the truck 10 and facilitates loading concrete materials 25 into the drum. For purposes of simplifying the description, the materials transported and delivered by the truck will generally be referred to as concrete materials, however, the present invention is not intended to be limited by the material carried by the truck. The term concrete materials as used in this description includes cement, water, aggregate and/or other materials which may be carried by a concrete mixer truck as is well known.

The drum 16 may have internal components (not shown), which are well known in the art and therefore will not be described in detail. The mixing drum is generally designed so that rotation of the drum causes the concrete materials 25 to mix. Rotation of the drum in an opposite direction causes the drum to dispense the concrete materials to a discharge guide 26. The discharge guide directs the material in a generally downward direction to a chute 28. The chute is generally hemicylindrical. The chute includes a main discharge chute 30 which is adjustably mounted to the chassis 15 and a fold-over discharge chute 32 which is mounted to a distal end of the main chute by a hinge 34. The fold-over chute retractably folds over the main chute for transport (FIG. 1) and extends to a position which is co-linear with the main chute to discharge or dispense the concrete materials (FIG. 2). The chute is hydraulically supported and positioned to adjustably direct the discharge of concrete materials. Additional or auxilliary chute sections 36 may be added to the distal end of the fold-over chute to increase the length of the chute and to facilitate delivery of the concrete materials to a desired location at a construction or job site.

Once the truck 10 arrives at the job site, the tag axle assembly 18 is generally carried in a substantially vertical, raised or upright position out of the way of the chute 28 to improve maneuverability of the truck and to facilitate delivery of the concrete materials 25. The tag axle assembly pivotally rotates between the upright position and a ground-engaging position in which the tag axle assembly assists the other wheeled axles 20 and 22 in supporting the load.

Figure 15:
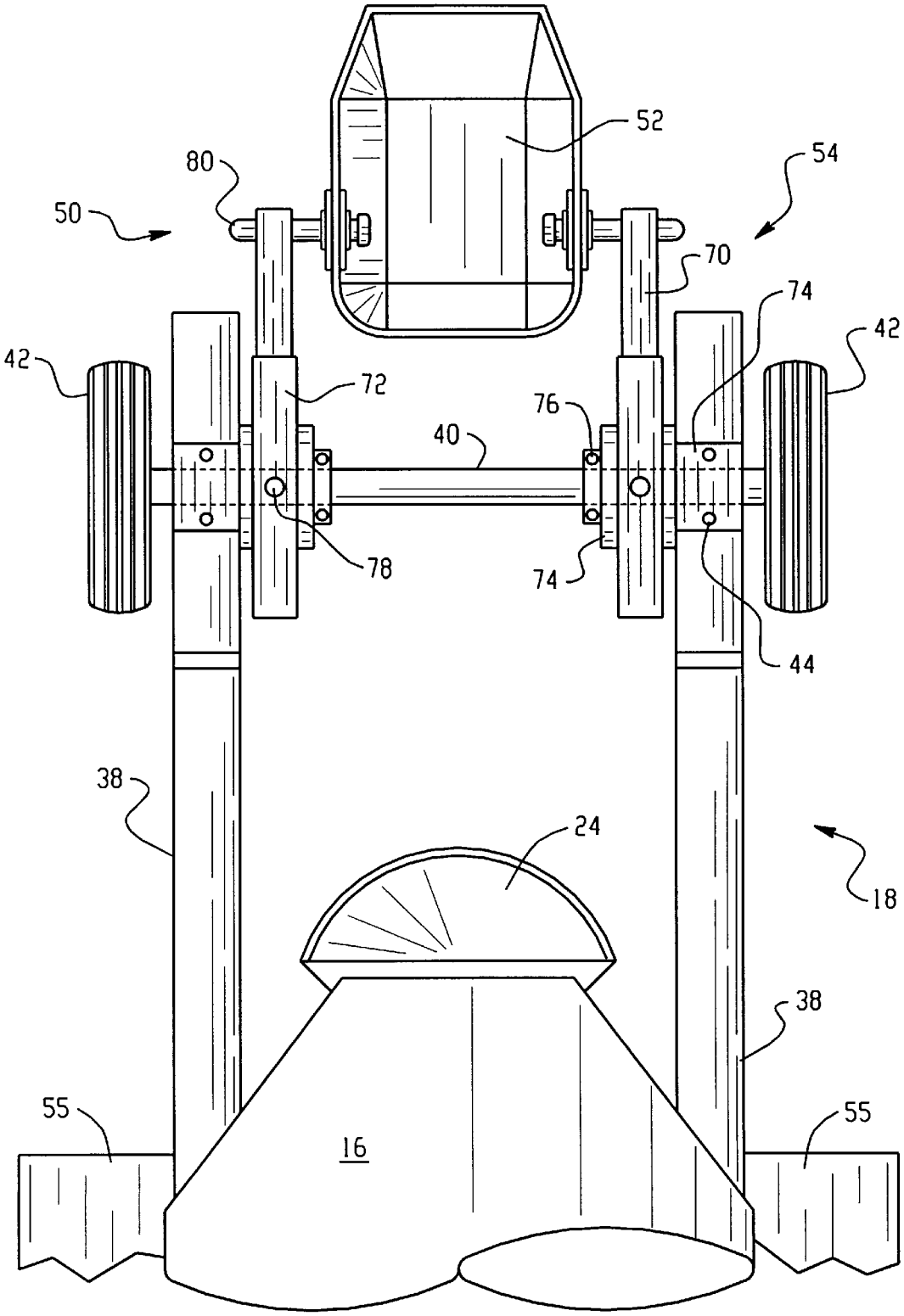
FIG. 15 is a schematic top view of the tag axle assembly connected to the washout assembly.

As shown in FIGS. 1 and 15, the tag axle assembly 18 includes a pair of parallel spaced apart arms 38 having a tag axle 40 supported between distal ends of the arms. A pair of wheels 42 are rotatably mounted to the axle which may be connected to the arms with U-bolts 44, for example. The arms are pivotally raised and lowered through substantially vertical planes by suitable means, such as hydraulics, as is well known.

The previously mentioned washout assembly 50, shown in FIG. 15, has a container 52 to receive waste material washed from equipment used to deliver the concrete materials, such as the chute 28 and shovels, rakes and other tools used to spread and finish the concrete material surface. The waste materials include water, excess concrete materials and/or other debris washed from the equipment. The washout assembly also includes a mounting assembly 54 which connects the container to the tag axle assembly 18.

Referring briefly to FIGS. 1 and 15, the cement truck 10 also has a pair of fenders 55, generally referred to as catwalks (one shown), on opposing longitudinal sides of the chassis 15. The washout container or bucket 52 is mounted on one of the catwalks for transport, as will be further explained below.

Turning to FIGS. 9–14, the container 52 resembles a wheelbarrow in the preferred embodiment and has a pair of wheels 56 and a handle 58 to facilitate moving the container around the job site. Around a top edge and at least at a forward edge of the container is an outwardly extending flange or lip 60. A tip surface formed of a pair of L-shaped tip brackets 62 extends forward from a front surface of the container to facilitate a tipping action of the container as it is emptied into the mixing drum 16 (FIG. 1), as further explained below. Alternatively, the front surface may be shaped to form the tip surface as an integral part of the container.

The container 52 preferably also has a pair of support brackets 64 on opposing sides of the container to support a pivotal connection to the mounting assembly 54. In the illustrated preferred embodiment, the support bracket includes a pair of plates 66 having central bores 68 aligned with at least one of a pair of openings in opposing sides of the container. As particularly illustrated in FIG. 14, the plates are bolted on inner and outer sides of the container to strengthen and reinforce the container about the openings where the mounting assembly connects to the container.

Figure 9:
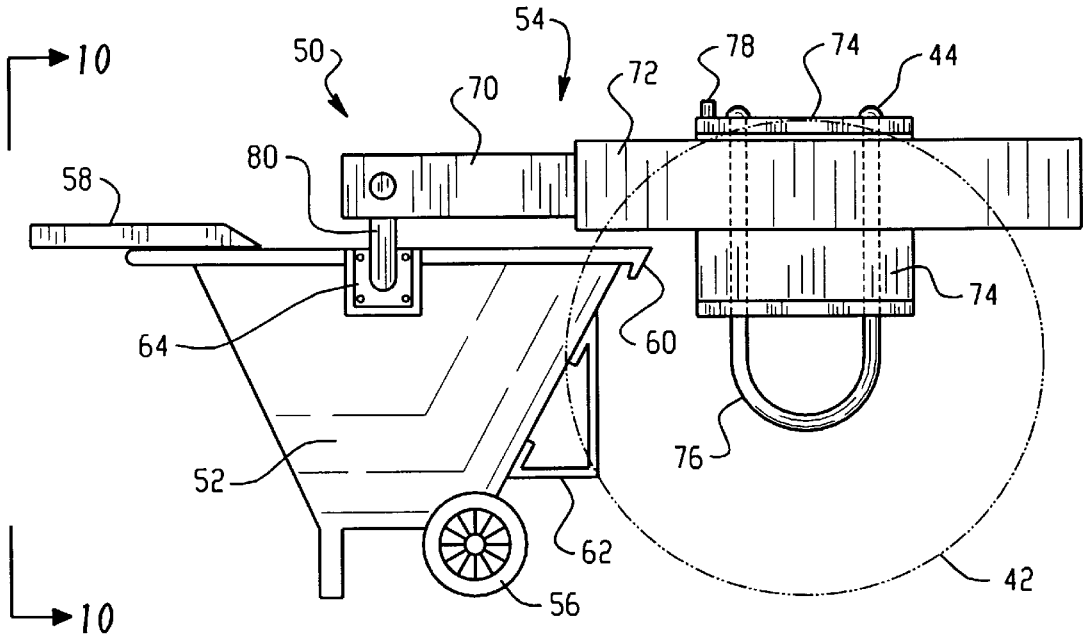
FIG. 9 is an enlarged elevational view of part of the tag axle assembly illustrating the connection with the washout assembly.
Figure 10:
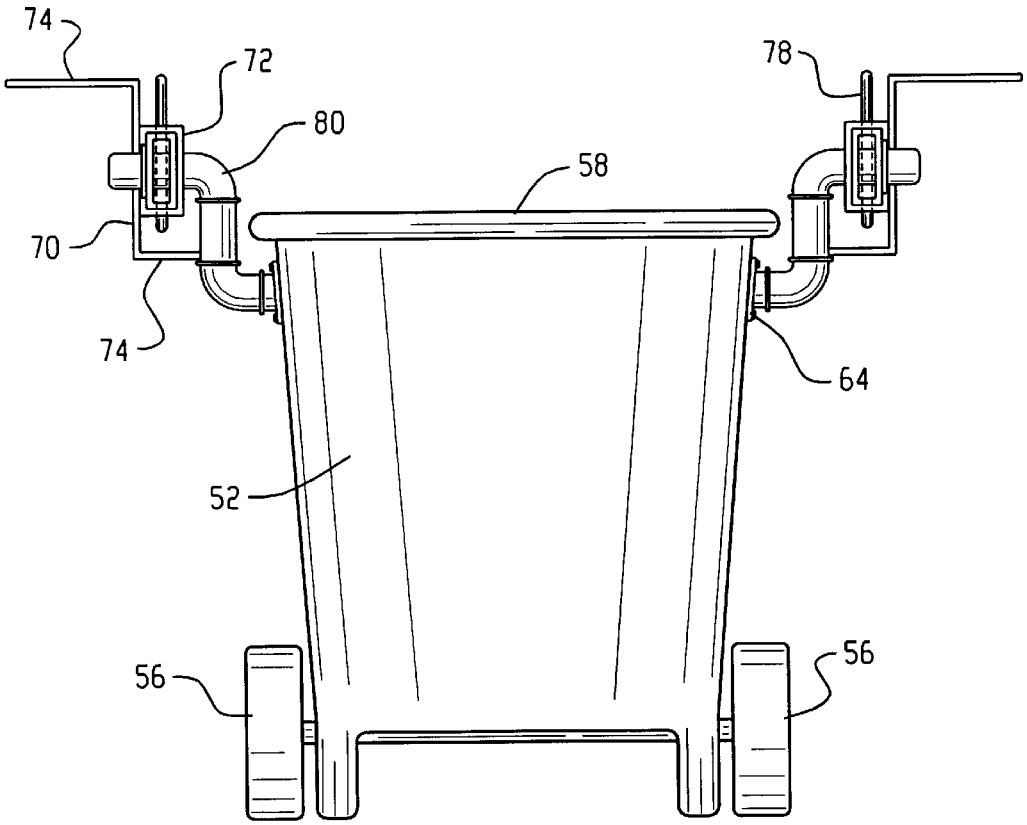
FIG. 10 is a view of the washout assembly as seen from line 10—10 of FIG. 9.
Figure 12:
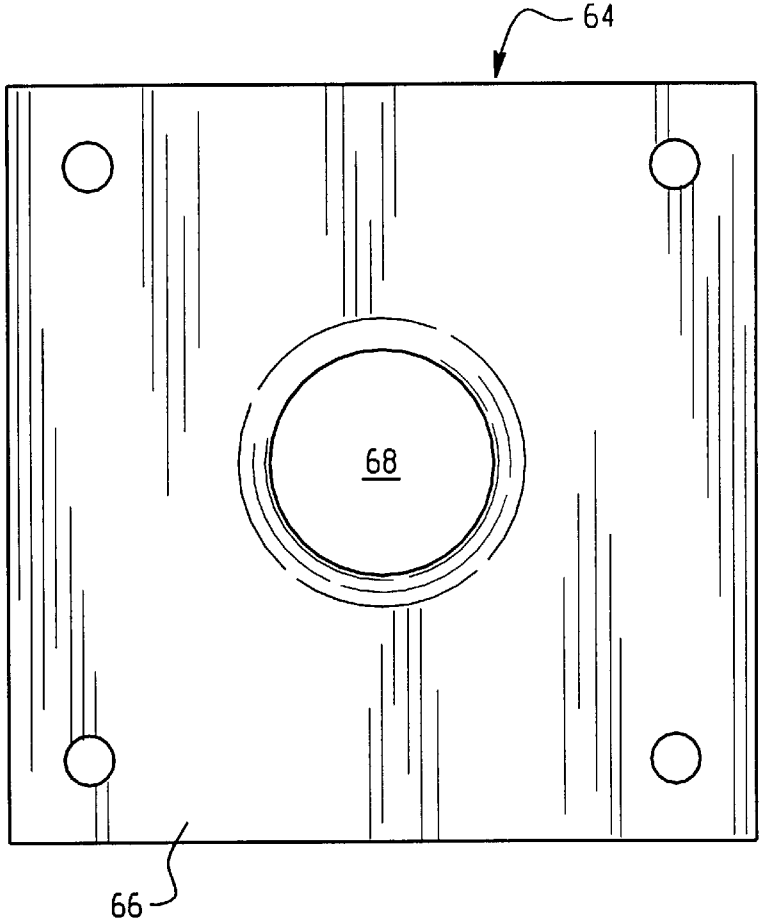
FIG. 12 is a front view of the support brackets as seen along line 12—12 in FIG. 11.
Figure 11:
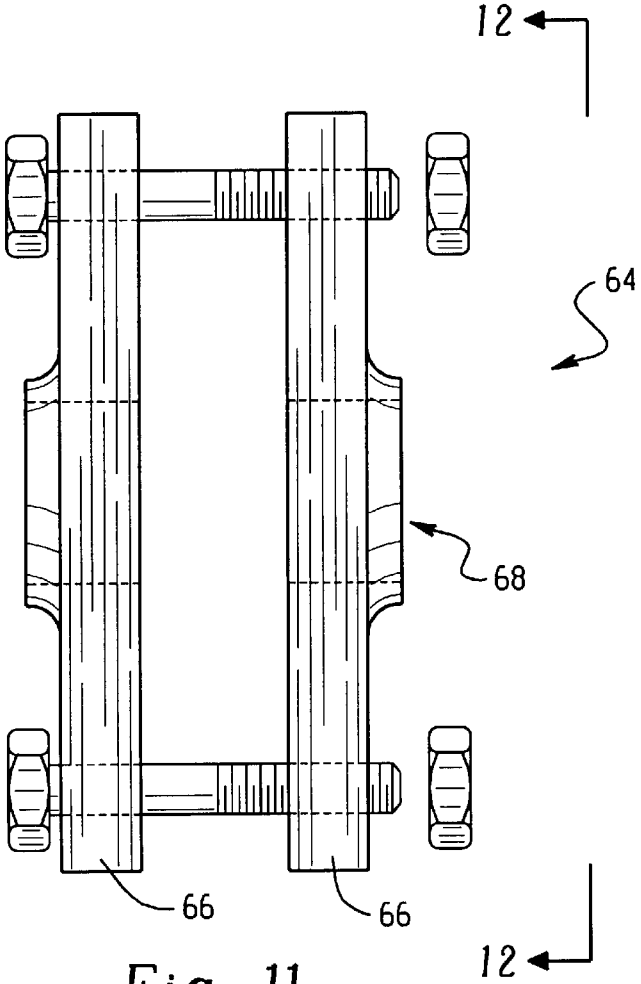
FIG. 11 is a view of support brackets of the washout container.

As shown in FIGS. 9, 10 and 15, the mounting assembly 54 includes a pair of extension members 70 telescopically extendable from a pair of parallel spaced apart bracket sleeves 72 mounted on the tag axle assembly 18. In the preferred illustrated embodiment the bracket sleeves are mounted to respective arms 38 of the tag axle assembly adjacent the tag axle 40. Flanges 74 extending from the bracket sleeve are connected to the tag axle assembly with a pair of U-bolts 44 and 76 on opposing sides of the bracket sleeve. The extension members preferably telescopically slide within the bracket sleeves. The extension members are supported by the bracket sleeves in an extended position for connection to the washout container 52 and a retracted position for transport. The position of the extension members in the bracket sleeves is fixed by locator pins 78 inserted through openings in the bracket sleeve and the extension member in a well known manner. Alternatively, the extension members may be permanently mounted on the tag axle assembly in a fixed position.

At distal ends of the extension members 70, the mounting assembly 54 includes pivotally mounted pivots 80 which are received in the support brackets 64 on the side of the container 52, preferably at a point above the center of gravity of the container. Although the container may be permanently connected, preferably the container is connectable to and disconnectable from the mounting assembly. The pivots preferably are permanently connected to the extension members and are removably connected to the container. Alternatively, the pivots may be connected to the container and connectable to and disconnectable from the extension members. As a further alternative, the pivots may be permanently connected to both the container and the extension members, and the extension members may be disconnectable from the bracket sleeves 72. Other combinations and variations of pivotable connection between the container and the tag axle assembly are contemplated by the present invention and will be apparent to a person of ordinary skill in the art.

Figure 14:
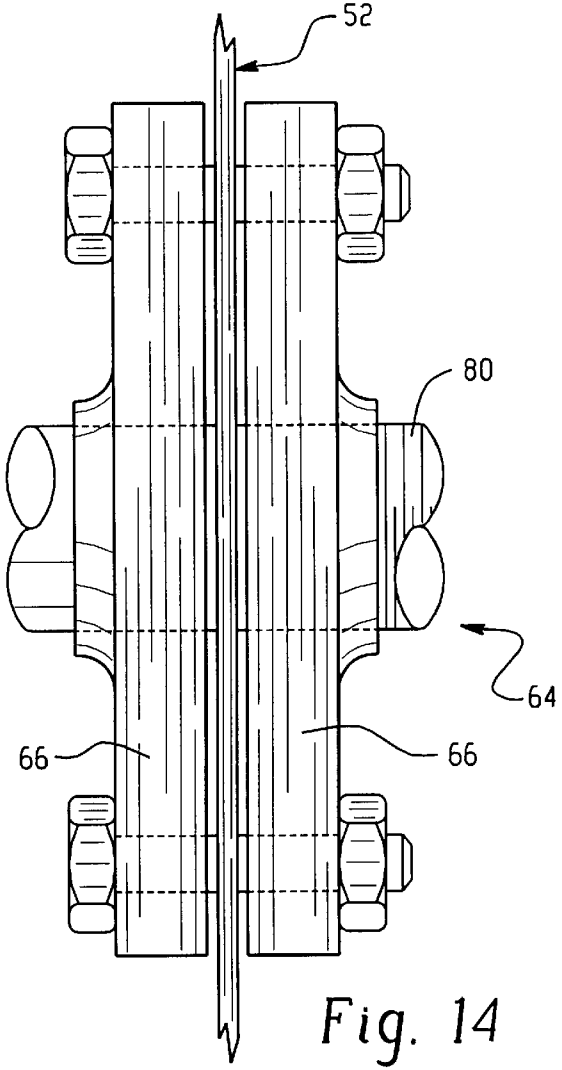
FIG. 14 is a schematic illustration broken from FIG. 13 of the support brackets mounted on the washout container.
Figure 13:
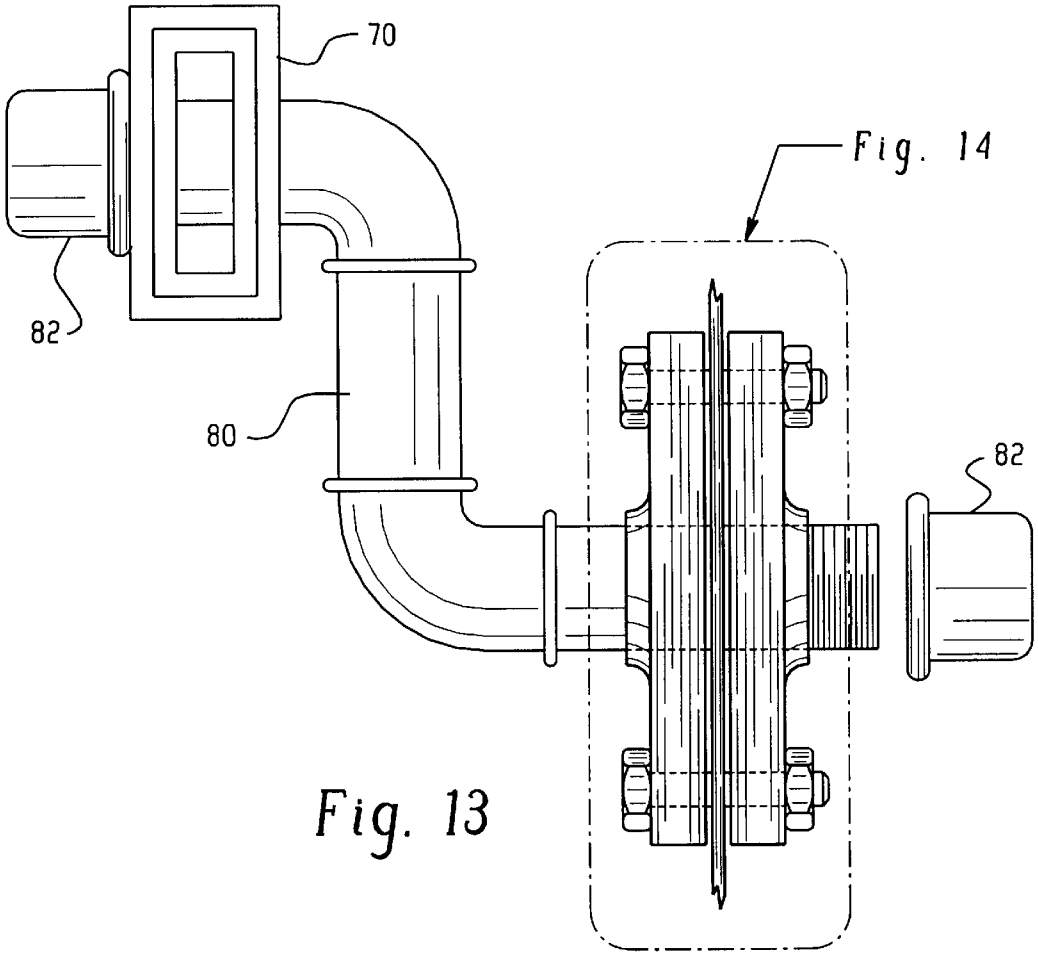
FIG. 13 is an enlarged schematic view of the rocker arms.

Referring to FIGS. 10, 13 and 14, the pivots 80 are formed of rocker arms having a substantially S-shape in the illustrated embodiment, however the pivots could be formed of a pair of straight pivots and/or a single pivot extending across the container 52. The rocker arms pass through the bores 68 of the support plates and the openings in the sides of the container. The container is held on the rocker arms by removable end caps 82.

Figure 16:
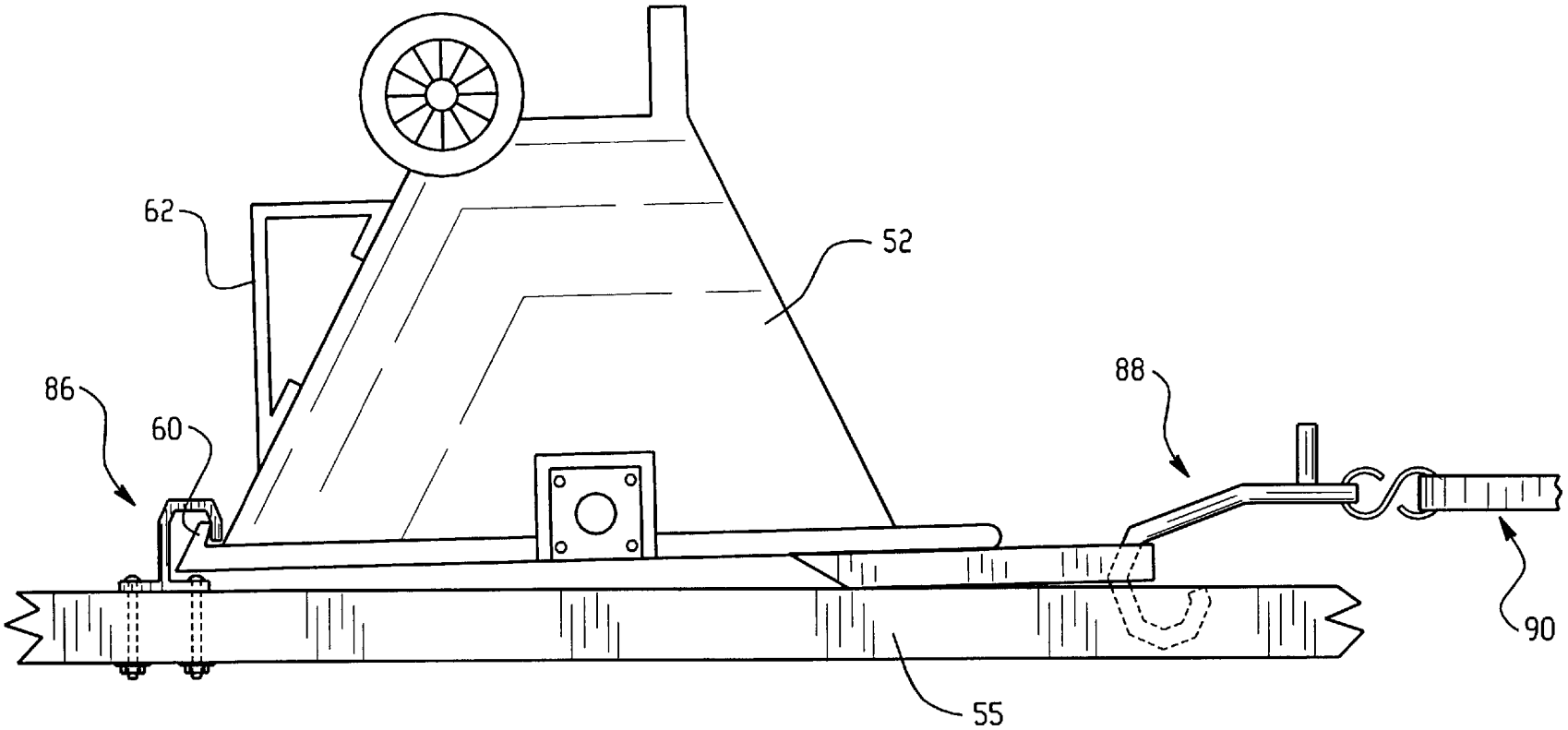
FIG. 16 is an enlarged schematic elevational view of the washout container secured to a catwalk on a side of the concrete mixer truck for transport.
Figure 18:
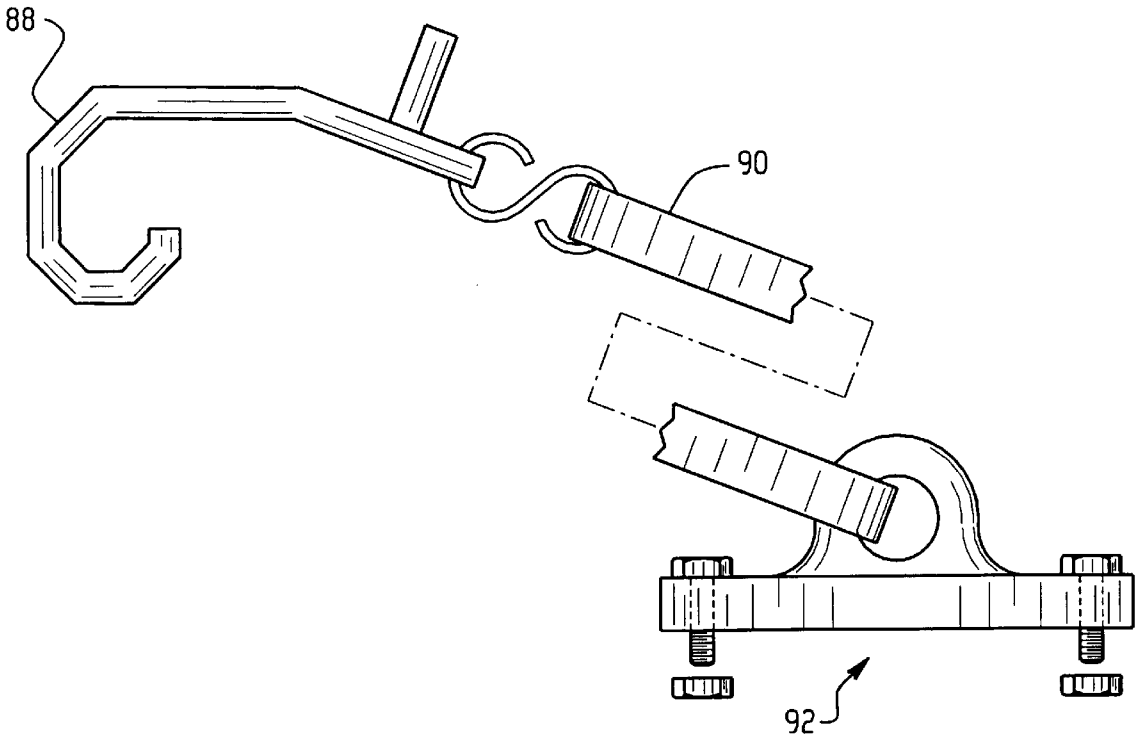
FIG. 18 is an enlarged schematic view of a releasable hook used to hold an opposite end of the washout container on the catwalk.
Figure 17:
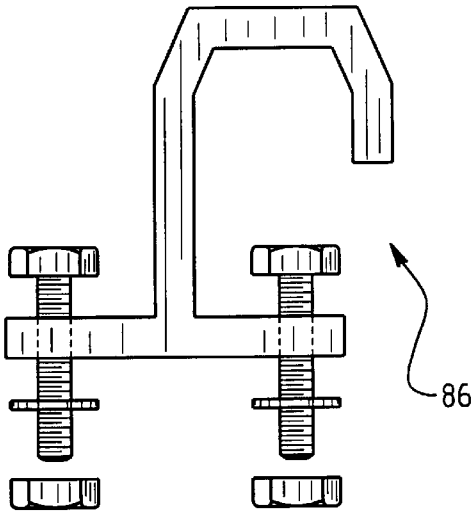
FIG. 17 is an enlarged schematic view of a hold down bracket used to hold one end of the washout container on the catwalk.

Turning to FIGS. 16–18, the washout container 52 is shown mounted on the catwalk 46 for transport. The lip 60 at one end of the washout container is held down by a hold down bracket 86 mounted to the catwalk. An opposite end of the container is connected to the catwalk with a releasable hook 88, which may be connected to an elastic member 90 such as a bungee cord or the like by a clamp 92 to further releasably secure the washout container on the catwalk. Other hold down mechanisms may be used to releasably secure the washout container for transport, either on the catwalk or some other part of the truck.

The method of using the present invention will be described with reference to FIGS. 1–6. The washout container 52 is attached to the truck 10 for transport in the manner described above. The chute 28 is extended, rotation of the mixing drum is reversed to dispense concrete materials 25 through the chute, and the container is removed from the catwalk 46. Although concrete materials are generally delivered directly from the chute, concrete materials may be dispensed to the washout container or other delivery device which then may be maneuvered to deliver the concrete materials to locations that the chute and/or the truck cannot reached.

Figure 4:
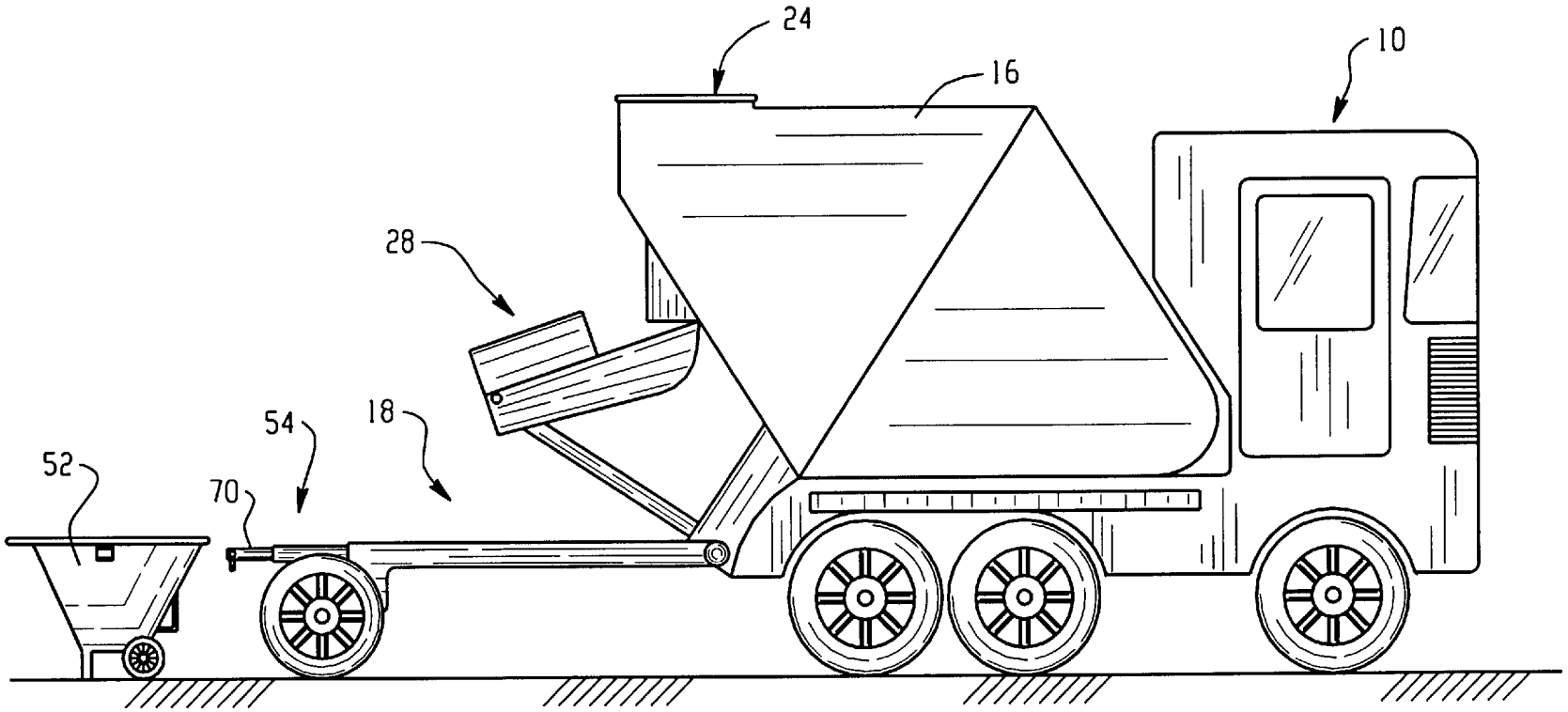
FIG. 4 is a schematic elevational view showing the concrete mixer truck with the tag axle assembly lowered to extend extension members of the washout assembly and to connect the washout container to the tag axle assembly.
Figure 5:
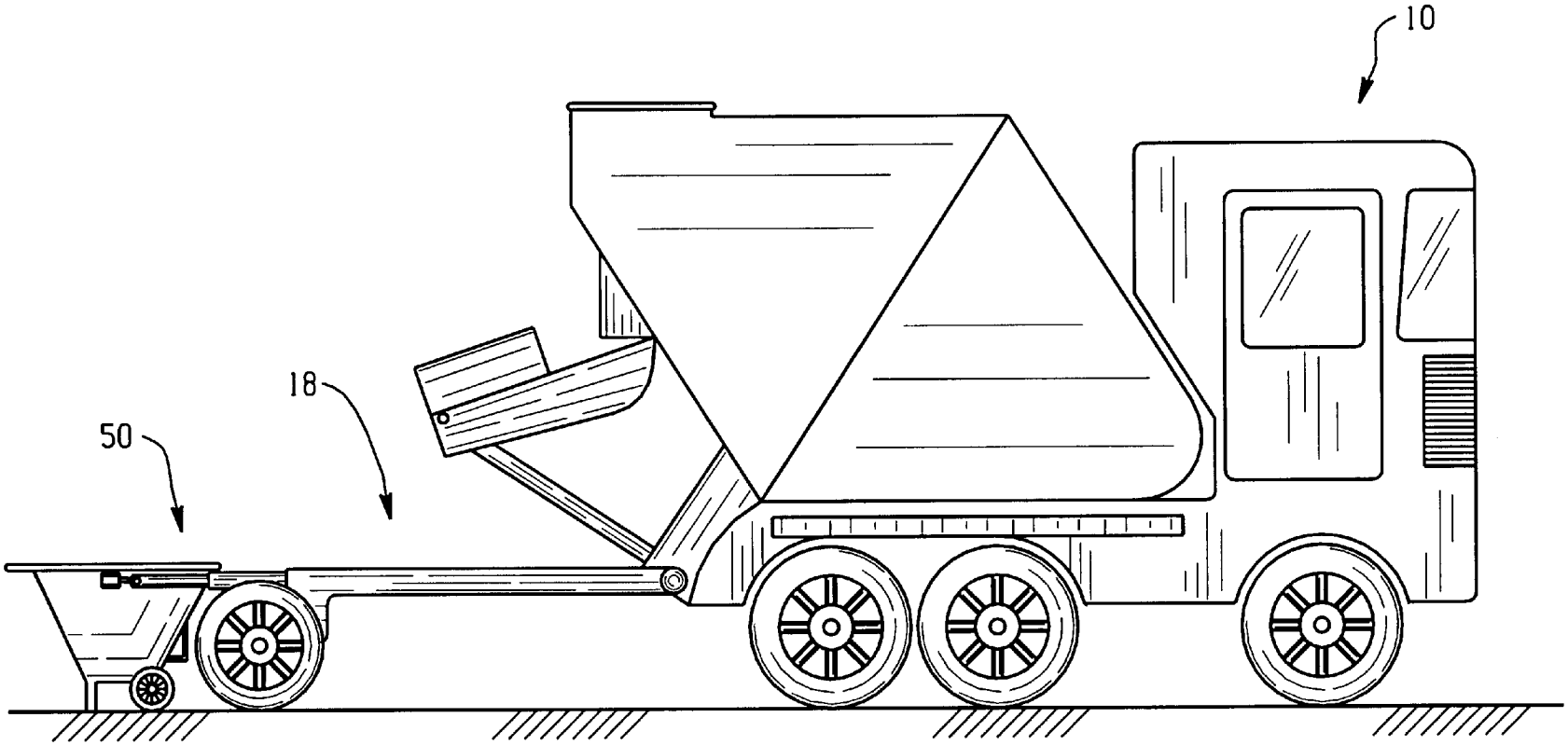
FIG. 5 is a schematic elevation view of the concrete mixer truck and the washout assembly connected to the tag axle assembly.

After the concrete materials 25 are dispensed, the container 52 is placed in a position to receive waste which is washed from the chute 28 and any other equipment used to spread or deliver the concrete materials 25. The clean chute is stowed by folding the fold-over chute 32 over the main chute 30, and the tag axle assembly 18 is lowered to its ground-engaging position. The locator pins 78 are removed and the extension members 70 are extended from their retracted positions to their extended positions. The locator pins 78 are replaced to hold the extension members 70 in their extended positions, as shown in FIG. 4.

The support brackets 64 on the sides of the washout container 52 are connected to the tag axle assembly 18 through the extension members 70 and the pivots 80 as described above. For example, the end caps 82 may be removed, ends of the rocker arms may be inserted through the bores 68 of the support brackets 64 and the openings in the container, and the end caps may be replaced to hold the container on the rocker arms (see FIGS. 13 and 14).

Figure 6:
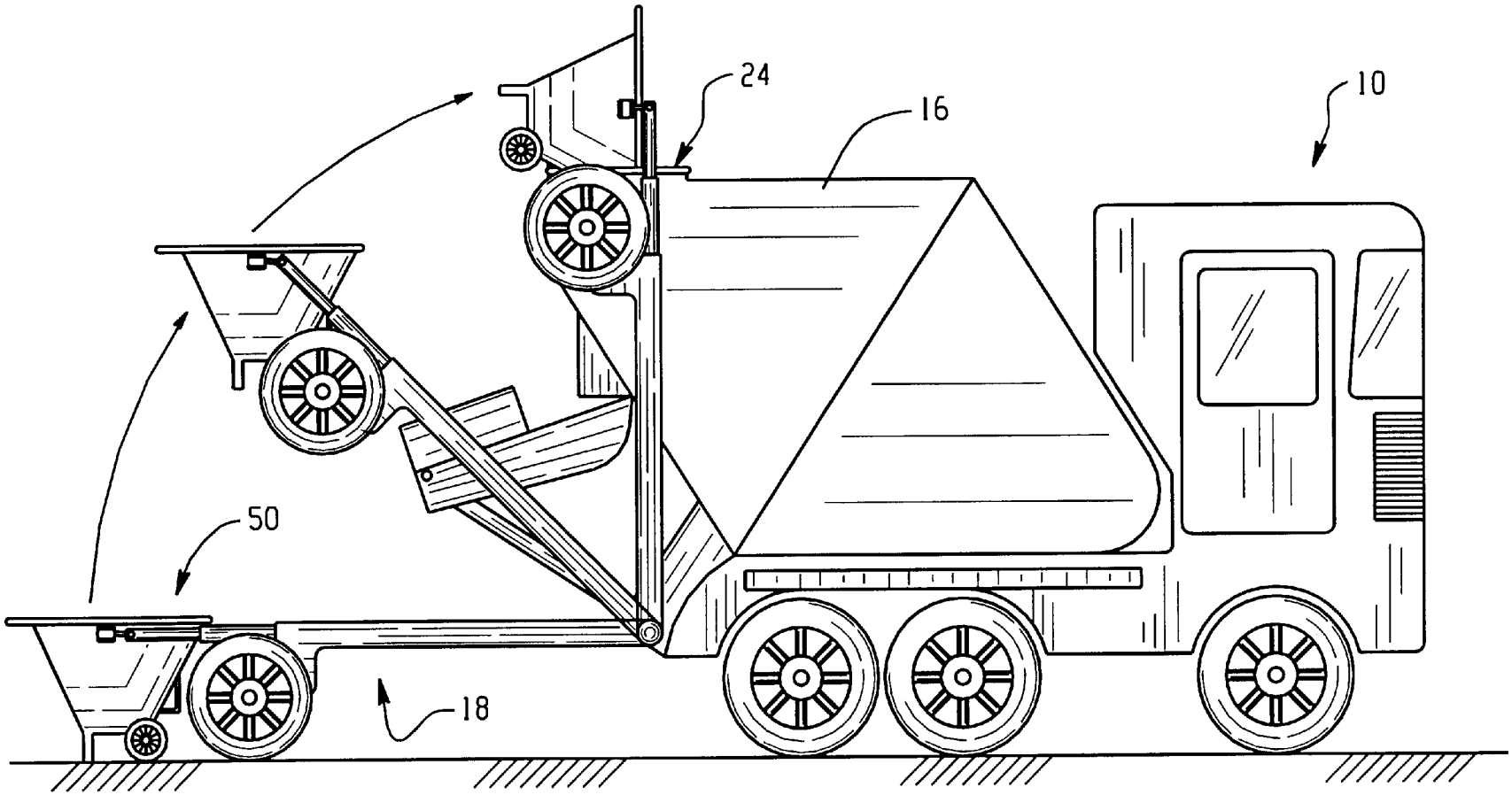
FIG. 6 is a schematic sequential elevational view of the concrete mixer truck with the washout assembly connected to the tag axle assembly which lifts the washout container and empties the container into a mixing drum of the truck.
Figure 7:
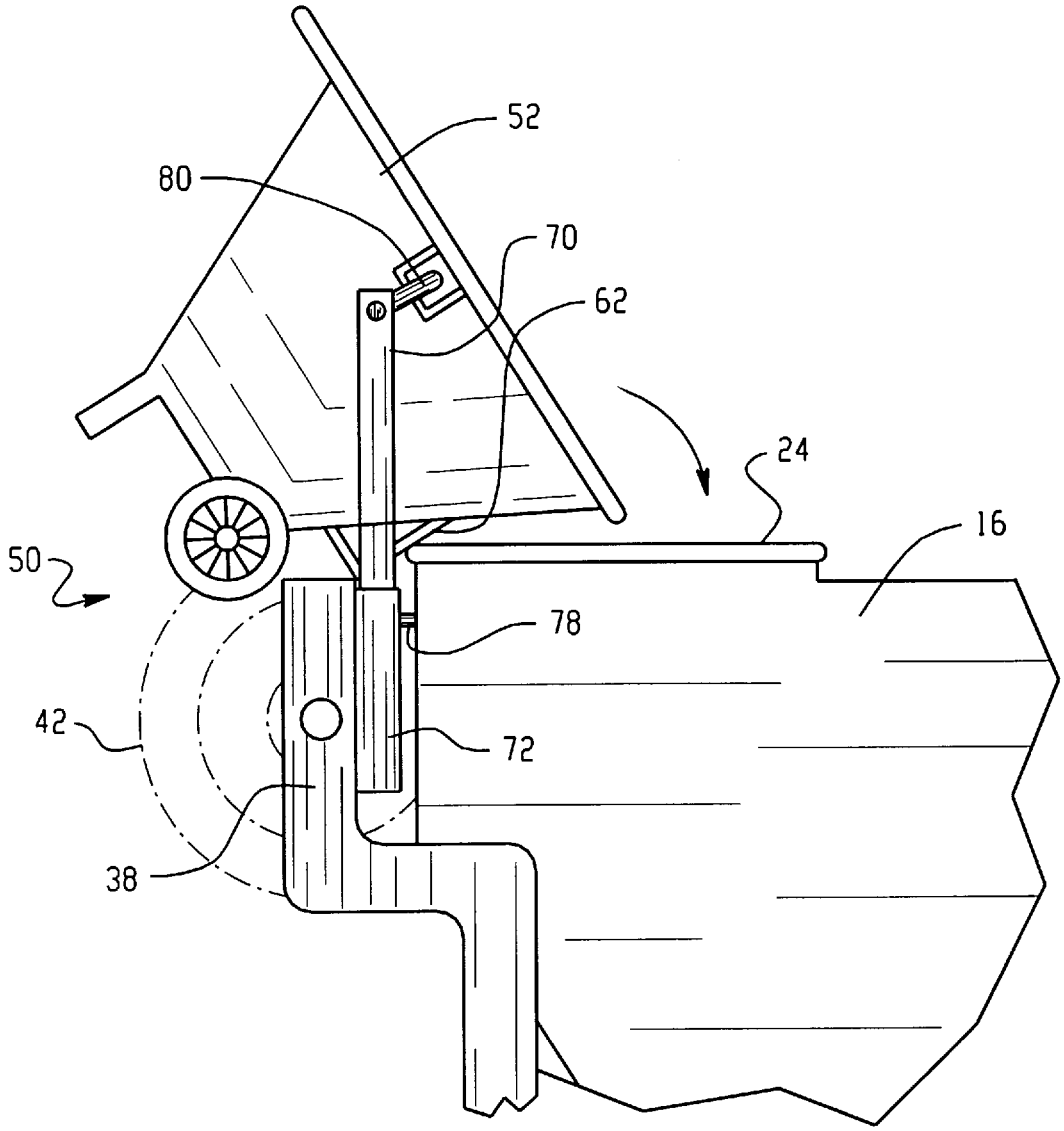
FIG. 7 is an enlarged elevational view of part of the truck of FIG. 6 which illustrates the contact between the washout container and a loading funnel on the mixing drum.

As shown in FIG. 6, the tag axle assembly 18 is raised thereby also lifting the washout container 52. As the tag axle assembly is raised, the pivots formed by the rocker arms 80 rotate relative to the washout container and the extension members 70 to keep the container upright and to prevent the waste from spilling.

Figure 8:
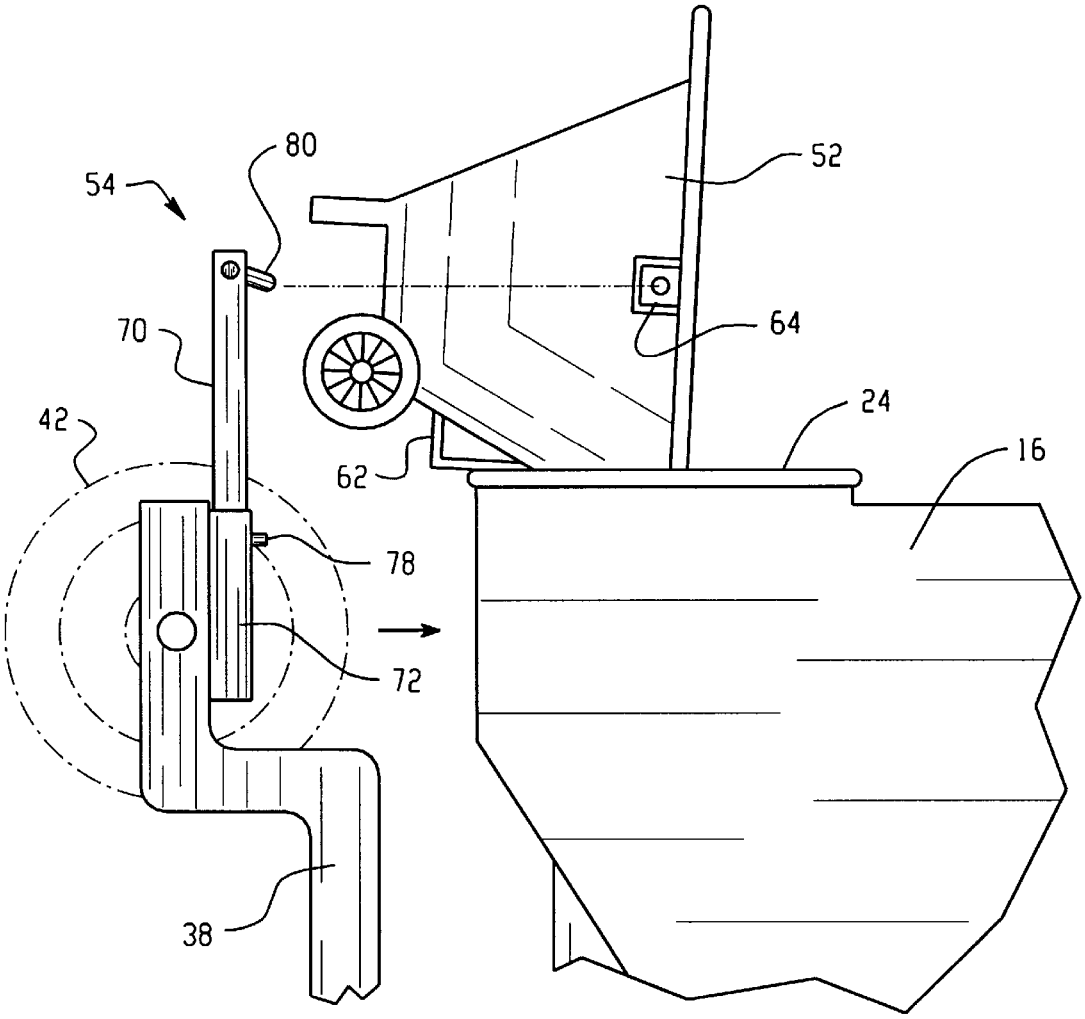
FIG. 8 is an exploded view of FIG. 7 showing the contact between the washout container and the loading funnel.

As shown more clearly in FIG. 8, as the tag axle assembly raises the washout container, the tip surface formed by the tip brackets 62 contacts an edge of the loading funnel 24 or other part of the mixing drum 16 at a point of contact and continued rotation of the tag axle assembly causes the washout container to rotate about the point of contact. Further rotation of the tag axle assembly causes the container to tip and empty the waste material 25 into the loading funnel and into the mixing drum.

The dumping action of the washout container 52 is shown more clearly in FIG. 9 with the tag axle assembly 18 and the mounting assembly 54 pulled away. In this dumping or emptying position, the washout container can be further cleaned to wash any remaining residue into the mixing drum

16. The tag axle assembly is lowered back to the ground engaging position and the washout container is disconnected, the extension members 70 are returned to their retracted positions and the container is re-attached to the catwalk 46 for transport.

Accordingly, the present invention provides a washout assembly which may be used in cooperation with the tag axle assembly of a cement truck to recover waste from the equipment used to deliver and spread the concrete materials, thereby solving the problem of waste concrete materials being washed indiscriminately onto the ground at a job site. The waste material can be recycled, reclaimed and/or properly disposed of at a remote location, thereby increasing the efficiency of the use of concrete materials as well.

Although the invention has been shown and described with respect to a certain preferred embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A concrete mixer truck having a mixing drum and a tag axle assembly which is connected to a rear end of the truck, comprising:

a washout container for receiving and collecting washout material from said mixer truck; and means for operatively connecting the washout container to the tag axle assembly such that pivotal movement of the tag axle assembly from a ground-engaging position to a raised position causes the washout container to empty said material from the washout container into the mixing drum.

2. The concrete mixer truck of claim 1, wherein the connecting means removably connects the container to the tag axle assembly.

3. The concrete mixer truck of claim 2, wherein the connecting means is removably connected to the container.

4. The concrete mixer truck of claim 2, wherein the container has at least one wheel to facilitate moving the container.

5. The concrete mixer truck of claim 4, wherein the container has a pair of wheels and a handle to facilitate moving the container.

6. A washout assembly for use with a concrete mixer truck having a tag axle assembly connected to a rear end of the truck, comprising:

a container to receive and collect waste washed from equipment used to deliver concrete material from the truck to a desired location; and a mounting assembly for connecting the container to the tag axle assembly.

7. The washout assembly of claim 6, wherein the mounting assembly is for pivotally connecting the container to the tag axle assembly.

8. The washout assembly of claim 6, wherein the mounting assembly is pivotally connected to opposite sides of the container along a horizontal tip axis.

9. The washout assembly of claim 8, wherein the container has a forward tip surface against which a force may be applied to tip the container about the horizontal tip axis.

10. The washout assembly of claim 9 wherein the tip surface is formed by at least one tip bracket extending from a front surface of the container.

11. The washout assembly of claim 6, wherein the mounting assembly includes at least one telescoping extension member.

12. The washout assembly of claim 11, wherein the mounting assembly includes at least one pivot which connects the container and the telescoping extension member.

* * * * *